United States Patent [19]

Larsson

[11] Patent Number: 4,755,259

[45] **Date of Patent: * Jul. 5, 1988**

[54] PROCESS FOR PAPERMAKING

[75] Inventor: Hans M. Larsson, Västra Frölunda, Sweden

[73] Assignee: EKA Nobel Aktiebolag, Surte, Sweden

[ * ] Notice: The portion of the term of this patent subsequent to May 31, 2000 has been disclaimed.

[21] Appl. No.: 945,161

[22] Filed: Dec. 22, 1986

Related U.S. Application Data

[63] Continuation of Ser. No. 737,568, May 23, 1985, abandoned, which is a continuation of Ser. No. 517,521, filed as PCT SE82/00401 on Nov. 26, 1982, published as W083/01970 on Jun. 9, 1983, abandoned.

[30] Foreign Application Priority Data

Nov. 27, 1981 [SE] Sweden ..... 8107078

[51] Int. Cl.[4] ..... D21H 3/20

[52] U.S. Cl. ..... 162/178; 162/175; 162/181.6; 162/183

[58] Field of Search ..... 162/178, 181.6, 183

[56] References Cited

U.S. PATENT DOCUMENTS

| | | | |
|---|---|---|---|
| 2,949,397 | 8/1960 | Werner et al. | 162/178 |
| 3,225,028 | 12/1965 | Nordgren | 162/178 |
| 3,303,184 | 2/1967 | Nordgren | 162/178 |
| 4,385,961 | 5/1983 | Svending et al. | 162/181.6 |
| 4,388,150 | 6/1983 | Sunden et al. | 162/181.6 |

*Primary Examiner*—Peter Chin

*Attorney, Agent, or Firm*—Luedeka, Hodges & Neely

[57] ABSTRACT

In making paper from an aqueous paper making stock, a binder comprising colloidal silicic acid and guar gum is added to the stock for improving the paper or the retention of the stock components so that the pollution problems and the amount of valuable substances in the white water are reduced. The guar gum is amphoteric or preferably cationic and may form part of the binder complex in a mixture with cationic starch. The weight ratio of guar gum to $SiO_2$ or of guar gum plus cationic starch to $SiO_2$ is between 0.1:1 and 25:1.

13 Claims, 8 Drawing Sheets

17
TENSILE INDEX (Nm/g)
70
60
50
40
30

INVENTION
GUAR GUM+SILICIC ACID SOL
14
REFERENCE
ONLY GUAR
GUM
11
18
B
C
ZERO TEST
15
A
12
19
16
13
10
20
30
FILLER CONTENT(%)

TENSILE ENERGY ABSORPTION INDEX (J/kg)
2000
1500
1000
500

17
INVENTION
GUAR GUM+SILICIC ACID SOL
14
11
REFERENCE
ONLY GUAR
GUM
18
C
15
B
ZERO TEST
12
A
19
16
13
10
20
30
FILLER CONTENT (%)

TENSILE INDEX(Nm/g)

70
60
50
40
51
46
54
52
55
56
53
47
50
49
48
10
20
30
FILLER CONTENT(%)

PROCESS FOR PAPERMAKING

This application is a continuation of application Ser. No. 737,568, filed May 23, 1985, which is a continuation of Ser. No. 517,521, filed as PCT SE82/00401 on Nov. 26, 1986, published as WO83/01970 on Jun. 9, 1983, both now abandoned.

The present invention relates in general to papermaking processes and, more particularly, to the use of a binder in a papermaking process, the binder comprising a complex of guar gum and colloidal silicic acid to produce a paper having improved strength and other properties. Such a binder, in addition, also effects highly improved levels of retention of added mineral materials as well as papermaking fines.

At the present time, the papermaking industry is plagued with a number of serious problems. First, the price of a cellulosic pulp has escalated materially and high quality pulp is in relatively short supply. Secondly, various problems including problems inherent in the disposal of papermaking wastes and the ecological requirements of various governmental bodies have markedly increased the cost of papermaking. Finally, the cost of energy required to make paper has increased materially. As a result, the industry and its customers are faced with two choices: either pay the higher costs or materially decrease the amounts and/or quality of the cellulosic fibers, with a consequential loss of quality of the finished paper product.

The industry has made various attempts to reduce the cost of the paper products. One approach that has been employed involves the addition of clay and other mineral fillers in the papermaking process to replace fiber but such additions have been found to reduce the strength and other properties in the resulting paper to a degree which is unsatisfactory. Also, the addition of such mineral filler results in poor retention of the filler materials, e.g. they pass through the wire to the extent that the level of filler materials builds up in the white water with the result that the clean-up of white water and the disposal of the material becomes a serious problem. Various retention aids have been employed in an attempt to alleviate the retention problem but their use has not been entirely satisfactory.

Attempts have also been made to use types of pulp which are less expensive and of lower quality, but this, of course, results in a reduction in the characteristics of the paper and often results in excessive fines which are not retained in the papermaking process with the consequent white water disposal problems.

Accordingly, the principal object of the invention is the provision of a binder system and a method which produce improved properties in paper and which will permit the use of minimum amounts of fiber to attain strengths and other properties which are required. Another object of the invention is the provision of a binder system and a method of employing it which materially increase the strength and other characteristics of paper as compared to a similar paper made with known binders. An additional object of the invention is the provision of a binder system and a method of employing it which maximize retention of mineral filler and other materials in the paper sheet when the binder is used in the stock on the papermaking machine. A further object of the invention is the provision of a paper having high mineral filler concentration which has acceptable strength and other characteristics.

Other objects and advantages of the invention will become known by reference to the following description and the appended drawings in which:

FIGS. 1–8 are diagrams of results in testing of paper sheets produced according to Examples presented below and illustrating various of the features of the invention.

The present invention is based on the discovery of a binder and a method of employing it which materially increase the strength and other characteristics of a paper product and which permit the use of substantial amounts of mineral fillers in the papermaking process while maximizing the retention of the filler and cellulosic fines in the sheet. This makes possible, for a given grade of paper, a reduction in the cellulosic fiber content of the sheet and/or the quality of the cellulosic fiber employed without undue reduction in the strength and other characteristics of the sheet. Also, by employing the principles of the invention the amount of mineral filler material may be increased without unduly reducing the strength and other characteristics of the resulting paper product. Thus, by a reduction in the amount of pulp employed to make a given sheet or the substitution of mineral filler for pulp, the reduction in fiber content permits a reduction in the energy required for pulping as well as a reduction in the energy required for drying the sheet. In addition, it has been found that the retention of the mineral filler and fines is at a sufficiently high level that white water problems are minimized.

In general, the system of the invention includes the use of a binder complex which involves two components, i.e. colloidal silicic acid and amphoteric or cationic guar gum. The weight ratio between the guar gum and the $SiO_2$ in the colloidal silicic acid is greater than 0.1 and less than about 25.

The binder system of the present invention may be combined with other binder systems. When combined with the binder system comprising cationic starch and colloidal silicic acid and disclosed in the published European patent application No. 81850084.5 (Publication No. 0041056), part of the guar gum is replaced by cationic starch, the weight ratio between, on the one hand, guar gum+cationic starch and, on the other hand, $SiO_2$ in the colloidal silicic acid being also above 0.1 and below about 25.

Cationic and amphoteric guar gums are soluble in cold water, which is advantageous as compared with most cationized starches which require hot water or boiling. A further advantage of amphoteric, and in particular cationic, guar gums is that their reactive sites are more accessible than the reactive sites of cationic starch, which makes it possible to use smaller amounts of a binder to attain the same effect if guar gum is employed. The probable explanation of this phenomenon is that guar gum molecules form straight chains, whereas a number of starch molecules form helical chains.

It has been found that, after drying, the sheet has greatly enhanced strength characteristics when using the principles of the present invention. Also, it has been found that when mineral fillers such as clay, chalk and the like are employed in the stock, these mineral fillers are effectiently retained in the sheet and further do not have the degree of deleterious effect upon the strength of the sheet that will be observed when the binder system of the present invention is not employed.

In conjunction with the making of sheet products, use has already been made of binders which are based on a combination of cationic substances and silicic acid. This is described, for example, in U.S. Pat. No. 3,253,978, which discloses an inorganic sheet in which use is made of a combination of cationic starch and silicic acid, but where flocculation is counteracted and the system operates with very high silicic acid contents. This patent specification teaches away from the present invention by stating that the cationic starch must not gel the silicic acid sol even if it has a tendency to flocculation. Gelling and flocculation are said to result in poor dewatering and an adhesion to the wire, and in a reduction of the porosity of the sheet produced, flocculation and gelling being, therefore, counteracted by pH adjustments.

In the papermaking process according to the published Swedish patent application No. 8003948-0 and the corresponding European patent application No. 81850084.5 (Publication No. 0041056), use is made of a binder which comprises colloidal silicic acid and cationic starch. This papermaking process also results in the above-mentioned excellent effects, but in some instances may entail too high a content of cationic starch in the paper with the consequent increase of the hardness of the paper, which in some cases may be unsuitable. This disadvantage can be overcome by utilizing the binder system of the present invention.

While the mechanism that occurs in the stock and during the paper formation and drying in the presence of the binder is not entirely understood, it is believed that the guar gum and the colloidal silicic acid form a complex agglomerate which is bound together by the anionic colloidal silicic acid and which also contains the cationic starch if present in the binder, and that the guar gum becomes associated with the surface of the mineral filler material whose surface is either totally or partly anionic. The guar gum and the optional cationic starch also become associated with the cellulosic fibers and the fines, both of which are anionic. Upon drying, the association between the agglomerate and cellulosic fibers provides extensive hydrogen bonding. This theory is supported in part by the fact that as the Zeta potentional in the anionic stock moves towards zero when employing the binder complex of the invention both the strength characteristics and the retention improve.

We have discovered that when a binder system of the type disclosed above is employed, the effect of the binder system may be enhanced by adding the colloidal silicic acid component in several increments, i.e. a portion of the colloidal silicic acid is first admixed with the pulp and the mineral filler when present, then the guar gum and the cationic starch, if present, are added and thereafter when a complex agglomerate of pulp, filler (if any), silicic acid and guar gum/starch is formed and before the stock is fed to the head box of the papermaking machine the remaining portion of the colloidal silicic acid is admixed with the stock containing the complex agglomerate. This procedure of supplying the colloidal silicic acid in two or more steps results in certain improvements in strength and other characteristics but the most striking improvement is the increase in retention of filler and papermaking fines. The reason for these improvements is not entirely understood but it is believed that they result from the production of complex filler-fiber-binder agglomerates which are more stable, i.e. that the later addition of the colloidal silicic acid causes the agglomerates initially formed to bond together to form even more stable agglomerates which are less sensitive to mechanical and other forces during the formation of the paper.

Based upon the work that has been done to date, the principles of this invention are believed applicable in the manufacture of all grades and types of paper, for example printing grades, including newsprint, tissue, paper board, liner and sack paper and the like.

It has been found that the greatest improvements are observed when the binder is employed with chemical pulps, e.g. sulfate and sulfite pulps from both hardwood and softwood. Lesser but highly significant improvements occur with thermo-mechanical and mechanical pulps. It has been noted that the presence of excessive amounts of lignin in groundwood pulps seems to interfere with the efficiency of the binder so that such pulps may require either a greater proportion of binder or the inclusion of a greater proportion of other pulp of low lignin content to achieve the desired result. (As used herein, the terms "cellulosic pulp" and "cellulosic fiber" refer to chemical, thermo-mechanical and mechanical or groundwood pulp and the fibers contained therein.)

The presence of cellulosic fibers is essential to obtain certain of the improved results of the invention which occur because of the interaction or association of the agglomerate and the cellulosic fibers. Preferably, the finished paper should contain over 50% cellulosic fiber, but paper containing lesser amounts of cellulosic fibers may be produced which have greatly improved properties as compared to paper made from similar stocks not employing the binder agglomerate described herein.

Mineral filler material which can be employed includes any of the common mineral fillers which have a surface which is at least partially anionic in character. Mineral fillers such as kaolin (china clay), bentonite, titanium dioxide, gypsum, chalk and talc all may be employed satisfactorily. (The term "mineral fillers" as used herein includes, in addition to the foregoing materials, wollastonite and glass fibers and also mineral low-density fillers such as expanded perlite.) When the binder complex disclosed herein is employed, the mineral fillers will be substantially retained in the finished product and the paper produced will not have its strength degraded to the degree observed when the binder is not employed.

The mineral filler is normally added in the form of an aqueous slurry in the usual concentrations employed for such fillers.

As mentioned above, the mineral fillers in the paper may consist of or comprise a low-density or bulky filler. The possibility of adding such fillers to conventional paper stocks is limited by factors such as the retention of the fillers on the wire, the dewatering of the paper stock on the wire, the wet and dry strength of the paper product obtained. We have now discovered that the problems caused by the addition of such fillers can be obviated or substantially eliminated by using the binder complex of the present invention which also makes it possible to add higher than normal proportions of such fillers to obtain special properties in the paper product. Thus, using the binder complex of the invention it has become possible to produce a paper product of lower density and consequently higher stiffness at the same grammage and simultaneously to keep the strength properties of the paper product (such as the modulus of elasticity, the tensile index, the tensile energy absorption and the surface picking resistance) at the same level as or even at a better level than before.

As pointed out above, the binder comprises a combination of colloidal silicic acid and amphoteric or cationic guar gum, possibly admixed with cationic starch. The colloidal silicic acid may take various forms, for example, it may be in the form of a polysilicic acid or colloidal silicic acid sols, although the best results are obtained through the use of colloidal silicic acid sols.

Polysilicic acid can be made by reacting water glass with sulfuric acid by known procedures to provide molecular weights (as $SiO_2$) up to about 100,000. However, the resulting polysilicic acid is unstable and difficult to use and presents a problem in that the presence of sodium sulfate causes corrosion and other problems in papermaking and white water disposal. The sodium sulfate may be removed by ion exchange through the use of known methods but the resulting polysilicic acid is unstable and without stabilization will deteriorate on storage. Salt-free polysilicic acid may also be produced by direct ion exchange of diluted water glass.

While substantial improvements are observed in both strength and retention with a binder containing polysilicic acid and amphoteric and in particular cationic guar gum, possibly in admixture with cationic starch, superior results are obtained through the use with the guar gum of colloidal silicic acid in the form of a sol containing about 2–60% by weight of $SiO_2$ and preferably about 4–30% by weight of $SiO_2$.

The colloidal silicic acid in the sol should desirably have a surface area of from about 50 to about 1000 $m^2/g$ and preferably a surface area of from about 200 to about 1000 $m^2/g$ with the best results being observed when the surface area is between about 300 and about 700 $m^2/g$. The silicic acid sol is stabilized with an alkali having a molar ratio of $SiO_2$ to $M_2O$ of from 10:1 to 300:1 and preferably a ratio of from 15:1 to 100:1 (M is an ion selected from the group consisting of Na, K, Li and $NH_4$). It has been determined that the size of the colloidal silicic acid particles should be under 20 nm and preferably should have an average size ranging from about 10 down to 1 nm. (A colloidal silicic acid particle having a surface area of about 550 $m^2/g$ involves an average particle size of about 5.5 nm).

In essence, it is preferably sought to employ a silicic acid sol having colloidal silicic acid particles which have a maximum active surface and a well defined small size generally averaging 4–9 nm.

Silicic acid sols meeting the above specifications are commercially available from various sources including Nalco Chemical Company, Du Pont & de Nemours Corporation and the assignee of this invention.

The guar gum which is employed in the binder according to the present invention is an amphoteric or cationic guar gum. Guar gum occurs naturally in the seeds of the guar plant, for example, Cyamopsis tetragonalobus. The guar molecule is a substantially straight-chained mannan which is branched at quite regular intervals with single galactose units on alternating mannose units. The mannose units are linked to one another by means of $\beta$-(1–4)-glycosidic linkage. The galactose branching is obtained through an $\alpha$-(1–6) linkage. The cationic derivates are formed by reaction between the hydroxyl groups of the polygalactomannan and reactive quaternary ammonium compounds. The degree of substitution of the cationic groups is suitably at least 0.01 and preferably at least 0.05 and may be as high as 1.0. A suitable range may be from 0.08 to 0.5. The molecular weight of the guar gum is assumed to range from 100,000 to 1,000,000, generally about 220,000. Suitable cationic guar gums are mentioned in the published European patent specification No. EP-A-0,018,717 (EP application No. 80300940.6) and No. EP-A-0,002,085 (EP application 78200295.0) in conjunction with shampoo preparations and rinsing agents for texiles, respectively. Natural guar gum provides, when used as a paper chemical, improved strength, reduced dust formation and improved paper formation. The disadvantage of natural guar gum is that it renders the dewatering process more difficult and thereby reduces production output or increases the need of drying. Admittedly, these problems have been overcome to a great extent by the introduction of the use of chemically modified guar gums which are amphoteric or cationic. However, the cationic or amphoteric guar gums which are available on the market have not previously been used in binder complexes of the type employed according to the present invention. There are commerically available guar gums with different cationization degrees and also amophoteric guar gums.

Amphoteric and cationic guar gums which may be used in connection with the present invention are commerically available from various sources, including Henkel Corporation (Minneapolis, Minn., USA) and Celanese Plastics & Specialities Company (Louisville, Ky., USA) under the trademarks GENDRIV and CELBOND.

If cationic starch is mixed with the guar gum for utilization in the binder according to the present invention, the cationic starch may be made from starches derived from any of the common starch-producing materials, e.g. corn starch, wheat starch, potato starch, rice starch etc. As is well known, a starch is made cationic by ammonium group substitution by known procedures, and may have varying degrees of substitution of up to 0.1. Best results have been obtained when the degree of substitution (d.s.) is between about 0.1 and 0.05 and preferably between about 0.02 and 0.04, and more preferably over about 0.025 and less than about 0.04. While a wide variety of ammonium compounds, preferably quaternary, are employed in making cationized starches for use in our binder, we prefer to employ a cationized starch which was prepared by treating the base starch with 3-chloro-2-hydroxypropyl-trimethyl ammonium chloride or 2,3-ethoxy-propyl-trimethyl ammonium chloride to obtain a cationized starch having 0.02–0.04 d.s.

In the papermaking process, the binder is added to the papermaking stock prior to the time that the paper product is formed on the papermaking machine. The two ingredients, the colloidal silicic acid components and the guar gum (possibly in admixture with cationic starch), may be mixed together to form an aqueous slurry of the binder complex which comprises silicic acid and guar gum (and possibly cationic starch) and which can then be added and thoroughly mixed with the papermaking stock. However, this method does not provide maximized results, especially if cationic starch is included. Preferably, the complex of silicic acid and guar gum and possibly cationic starch is formed in situ in the papermaking stock. This can be accomplished by adding the colloidal silicic acid component in the form of an aqueous sol and by adding the guar gum and the possible cationic starch in the form of an aqueous solution separately to the stock in a mixing tank or at a point in the system where there is adequate agitation so that the two components are dispersed with the papermaking components so that they interact with each other, and with the papermaking components at the same time.

Even better results are obtained if the colloidal silicic acid component is added to a portion of the stock and thoroughly mixed therewith after which the make-up of the stock is completed and the cationic starch component is added and thoroughly mixed with the stock prior to the formation of the paper product.

In the event that a mineral filler is to be added to the stock it has been found preferable to slurry the mineral filler in water with the colloidal silicic acid, or in the event of incremental additions of the colloidal silicic acid component, the initial portion of the colloidal silicic acid component and then to introduce the filler-colloidal silicic acid component slurry into a mixing device where it is incorporated into the stock along with the pulp and the guar gum and the possible cationic starch.

Thereafter, when using incremental additions of the colloidal silicic acid component, the final portion or portions of the colloidal silicic acid component are thoroughly mixed with the stock after the initial agglomerate is formed and prior to or at the time the stock is conducted into the head box. The initial addition of the colloidal silicic acid should comprise about 20 to about 90 percent of the total amount to be added and then, after the initial agglomerate is formed, the remainder should be added before the sheet is formed. Preferably the initial addition should comprise from about 30 to about 80% of the colloidal silicic acid component.

It has been found that in a papermaking process employing the binder complex described herein, the pH of the stock is not unduly critical and may range from a pH of from 4 to 9. However, pH ranges higher than 9 and lower than 4 are undesirable.

Also, other paper chemicals such as sizing agents, alum, and the like may be employed but care should be taken that the level of these agents is not great enough to interfere with the formation of the agglomerate of silicic acid and guar gum and possibly cationic starch and that the level of the agent in recirculating white water does not become excessive so as to interfere with the formation of the binder agglomerate. Therefore, it is usually preferred to add the agent at a point in the system after the agglomerate is formed.

According to the invention, the ratio of amphoteric or cationic guar gum to the colloidal silicic acid component should be between 0.1:1 and 25:1 by weight. The same weight ratio applies if part of the guar gum is replaced by cationic starch. Preferably, this ratio is between 0.25:1 and 12.5:1.

The amount of binder to be employed varies with the effect desired and the characteristics of the particular components which are selected in making up the binder. For example, if the binder includes polysilicic acid as the colloidal silicic acid component, more binder will be required than if the colloidal silicic acid component is colloidal silicic acid sol having a surface area of 300 to 700 $m^2/g$. Similarly, if the cationic guar gum, for example, has a d.s. of 0.3 as compared to a d.s. of 0.5, more binder will be required assuming the colloidal silicic acid component is unchanged.

In general, when the stock does not contain a mineral filler the level of binder may range from 0.1 to 15% by weight and preferably from 0.25 to 5% by weight based upon the weight of the cellulosic fiber. As pointed out above, the effectiveness of the binder is greater with chemical pulps so that less binder will be required with these pulps to obtain a given effect than other types. In the event that a mineral filler is employed the amount of binder may be based on the weight of the filler material and may range from 0.5 to 25% by weight and usually between 2.5 to 15% by weight of the filler.

Figure 1:
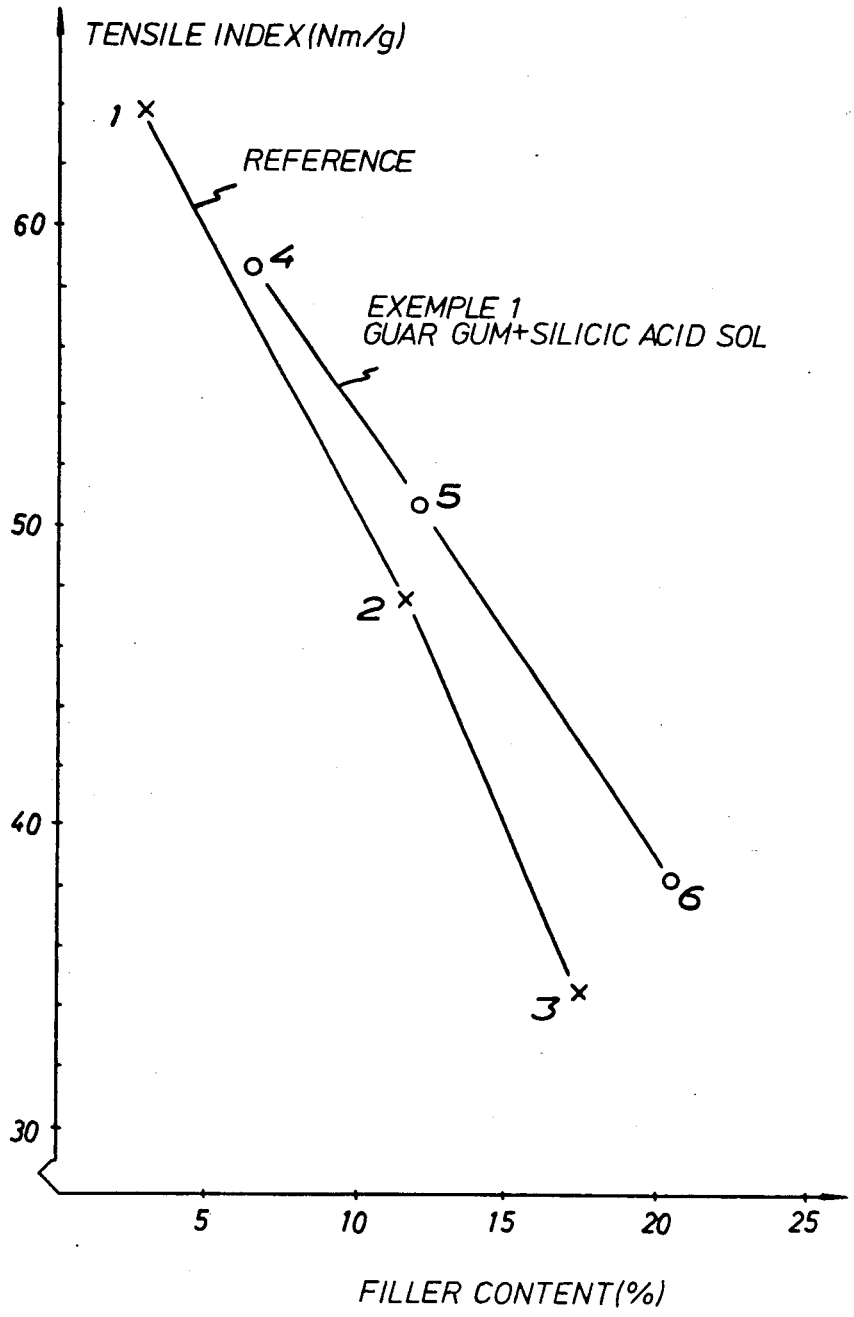
FIGS. 1, 4, 5 and 6 compare the effect on tensile strength and filler content between the use of cationic guar gum and silicic acid sol, and cationic polyacrylamide.

The invention will be illustrated in greater detail below by means of a number of Examples. These Examples disclose different beating methods and properties of the finished products. The following standards have been utilized for the various purposes involved:

| | |
|---|---|
| Beating in Valley Hollander | SCAN-C 25:76 |
| Beating degrees: | |
| Canadian Standard Freeness Tester | SCAN-C 21:65 |
| Schopper-Riegler | SCAN-C 19:65 |
| Sheet formation | SCAN-C 26:76 |
| Grammage | SCAN-P 6:75 |
| Density | SCAN-P 7:75 |
| Filler content | SCAN-P 5:63 |
| Tensile index | SCAN-P 38:80 |
| Z-strength | Alwetron |
| Ash content (quick ash) | Greiner & Gassner GmbH, Munich |
| Tensile energy absorption index | SCAN-P 38:80 |

When testing the produced sheets, these were conditioned first at 20° C. in air with a relative humidity of 65%.

The retention measurements related in the Examples were carried out by means of a so-called dynamic dewatering jar ("Britt-jar") which was provided with an evacuation pump and a measuring glass for collecting the first 100 ml of sucked-off water. In the measurements, use was made of a baffled dewatering vessel which had a wire (40 M) with a mesh size of 310 μm. The suck-off rate was controlled by means of glass tubes of different diameter and was 100 ml/15 s. in the experiments. The following measurement method was utilized:

1. 500 ml pulp suspension was added under agitation at 1000 rpm and timekeeping was started.
2. After 15 s, colloidal silicic acid and filler were added. The total solids content (fibres+filler) should be 0.5%.
3. After 30 s, the guar gum and/or the cationic starch were added.
4. After 45 s, the sucking off was started.
5. The first 100 ml of water were collected and filtered through a filter paper which had been weighed. The filter paper had been obtained from Grycksbo-Munktell, Sweden, and was of grade 00 with the capability to retain extremely fine grained precipitates, e.g. cold precipitated barium sulfate. The filter paper had a grammage of 80 g/m$^2$ and a filter speed of 150 ml/min according to Hertzberg.

6. The filter paper was dried, weighed and burned to ash.

7. The retention was calculated.

This retention measurement method is described by K. Britt and J. E. Unbehend in Research Report 75, 1/10 1981, published by Empire State Paper Research Institute ESPRA, Suracuse, N.Y. 13210, USA.

In the following Examples, commercially available guar gum, clay and chalk, as well as cationic starch have been utilized. Moreover, commercially available retention agents have been used as references.

The chalk "SJÖHÄSTEN NF" used in the Examples is a natural, high-grade calcium carbonate of amorphous structure and is marketed by Malmökrita Swedish Whiting Company Limited, Malmö, Sweden. The C grade clay and Superfill-clay used are kaolin purchased from English China Clay Limited, Great Britain.

The different guar gum types employed were as follows:

GENDRIV 158 and 162 are cationic guar gum types, GENDRIV 58 having moderate and GENDRIV 162 strong cationic activity. Both were purchased from Henkel Corporation, Minneapolis, Minn., USA.

CELBOND 120 and CELBOND 22 are guar gum types purchased from Celanese Plastics and Specialities Company, Louisville, Ky., USA. CELBOND 120 is an amphoteric guar gum with both cationic and anionic properties.

CELBOND 22 is a low-substituted cationic guar gum with added quatenary ammonium groups.

PERCOL 140 is a cationic polyacrylamide which was used as retention aid and was purchased from Allied Colloids, Great Britain.

PERCOL E24 is an anionic polyacrylamide which was used as retention aid and was purchased from Allied Colloids, Great Britain.

The contents indicated in the following Examples are all calculated on a dry weight basis.

EXAMPLE 1

In a laboratory wire mould, hand-made sheets were made from various stocks having the compositions stated in Table 1. For the pulp, use was made of fully bleached softwood sulfate pulp made from pine and having been beaten in a Valley hollander to 470 CFS. Kaolin (C-clay from English China Clay Limited) was used as filler and was added as a clay slurry in a concentration of 100 g/l. The pH of the stock was adjusted to 4.4, using sulfuric acid. As binder, use was made of a combination of cationic guar gum (GENDRIV 162) and silicic acid sol, a comparison being carried out with reference stocks 1–3 which contained the previously known retention aid PERCOL 140 (cationic polyacrylamide). The silicic acid sol employed was a 1.5% silicic acid sol with a surface area of 505 m$^2$/g and a ratio $SiO_2$:$Na_2O$=35. In the experiment, the clay slurry was first treated with the silicic acid sol for 0.5 h. For preparing the stock, the pulp was first batched, and then the clay slurry and the silicic acid sol mixed therewith. Thereafter, an aqueous solution of cationic guar gum (concentration 0.5%) or PERCOL (concentration 0.01%) was added, followed by pH adjustment to 4.4, using sulfuric acid. Finally, sheet forming was carried out. The properties of the thus obtained hand sheets appear from Table 1. The results are also illustrated in the diagram in FIG. 1. It can be ascertained from the Table and the diagram that the use of the binder complex according to the present invention makes it possible to increase the filler content while maintaining the tensile index.

EXAMPLE 2

In a laboratory wire mould, hand-made sheets were made from various stocks the compositions of which are apparent from Table 2 and which had the properties stated in Table 2. The same pulp and filler were used as in Example 1, the proportions in stock 8 being 70% clay and 30% pulp and in the other stocks 30% clay and 70% pulp. The binder was formed of cationic guar gum which was added as a 0.5% aqueous solution and consisted of either GENDRIV 162 with a nitrogen content of 1.5%, or CELBOND 22 with a nitrogen content of 0.95%. As silicic acid sol, use was made of a 1.5% silicic acid sol with a specific surface of 550 m$^2$/g and a ratio $SiO_2$:$Na_2O$=45. In reference samples 7 and 8, no chemical additives were used. The stocks 9 and 10 are in accordance with the present invention. The pH was adjusted to 7.0. The batching order in the preparation of the stock was the same as in Example 1.

This Example shows that both high substituted cationic guar gum (stock 10) and low substituted cationic guar gum (stock 9) result in an increased filler content in the paper.

EXAMPLE 3

In a laboratory wire mould (Formette Dynamique), hand-made sheets were prepared from different stocks having the compositions presented in Table 3. In this Example, use was made of a pulp of 50% birch sulfate and 50% pine sulfate with a beating degree of 20% SR. The filler consisted of C-clay in the form of a 10% aqueous slurry. As binder, use was made of a 0.5% aqueous solution of cationic guar gum (GENDRIV 158) and a 1.5% silicic acid sol with a surface area of 530 m$^2$/g and a ratio $SiO_2$:$Na_2O$=35. In the zero tests (stocks 11–13), no chemical additives were used. In reference tests 14–16, only the guar gum was used, but no silicic acid sol. Stocks 17–19 are prepared in accordance with the present invention. The preparation of the stock and forming of the sheets were carried out according to Example 1, pH being adjusted to 7.5.

Figure 2:
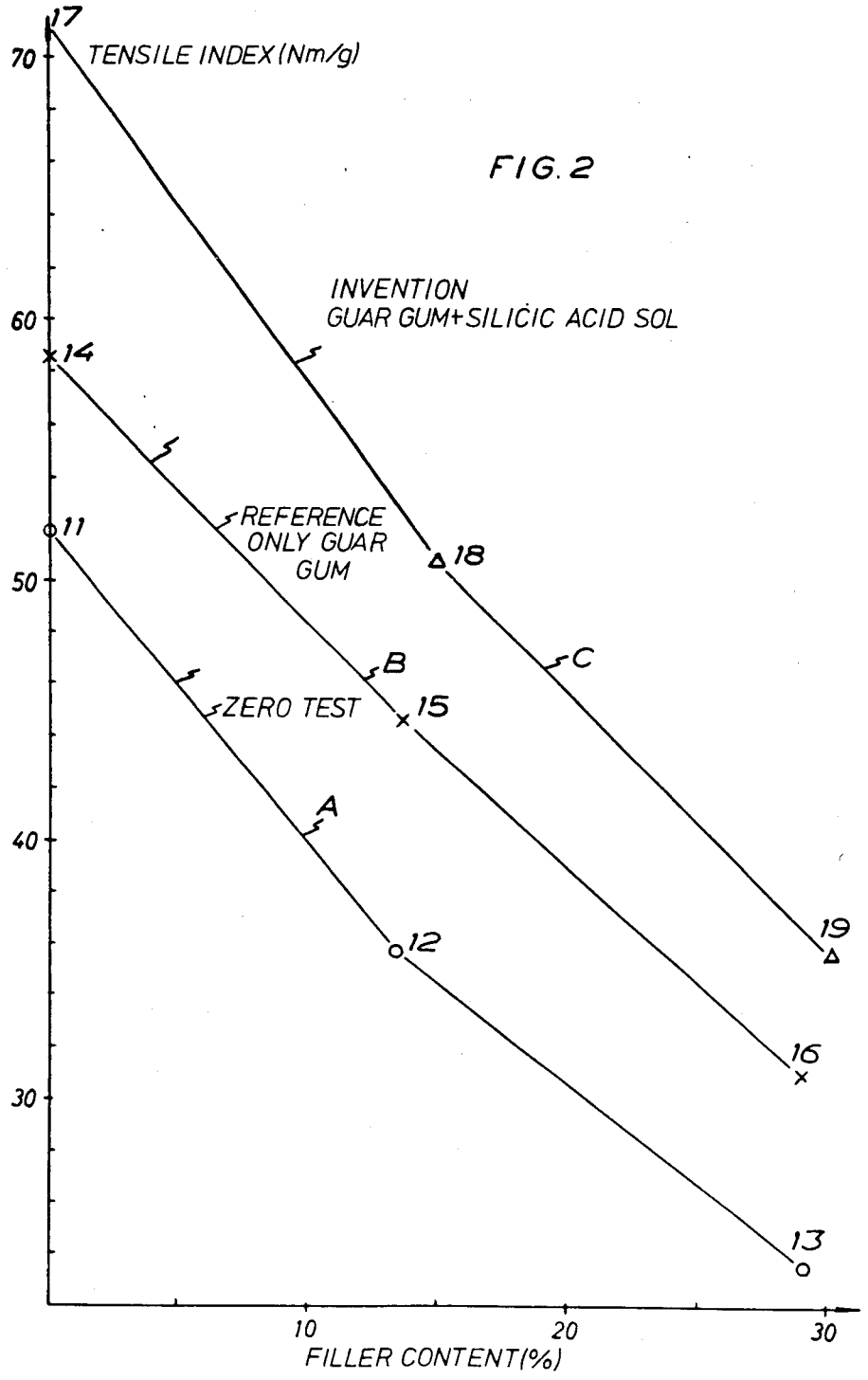
FIGS. 2 and 3 compare the effect on tensile strength and filler content using cationic guar gum and silicic acid sol and sheets prepared from guar gum and no chemical additives.
Figure 3:
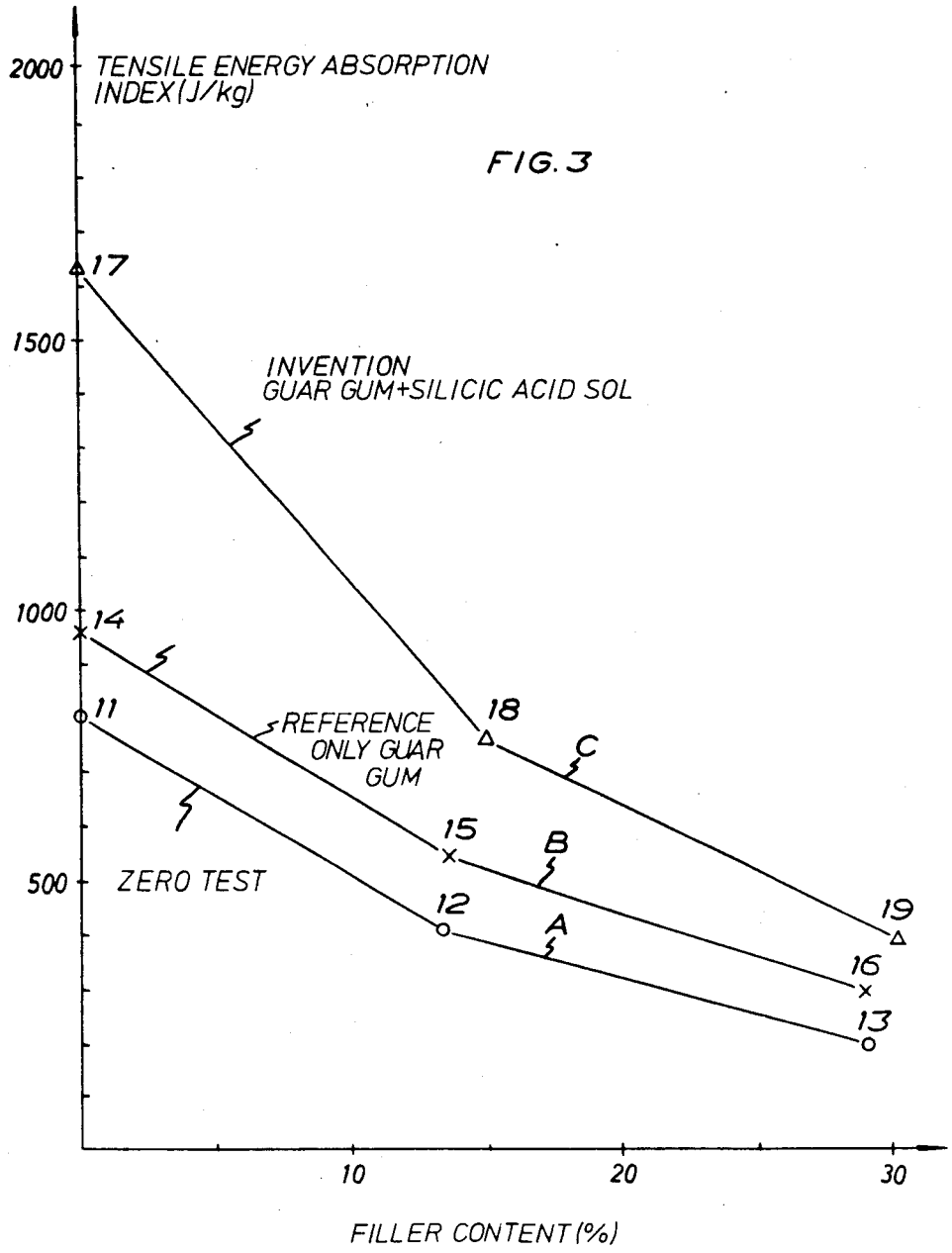

Table 3 gives the stock compositions and the test results. The test results are also illustrated in diagrams in FIGS. 2 and 3, where curve A relates to the zero tests, curve B to the reference tests and curve C to the invention with the binder complex guar gum+silicic acid sol. It will be appreciated from FIG. 2 that although the addition of guar gum resulted in an increase in the filler content at equal tensile index, the improvement was considerably greater when utilizing the present invention. It will be appreciated from FIG. 3 that a great improvement of the tensile energy absorption index is obtained by the present invention.

EXAMPLE 4

In this Example, hand-made sheets were made in a laboratory wire mould utilizing stocks which were prepared from fully bleached pine sulfate with a beating degree of 470 CSF. As filler, use was made of C-clay in the form of a 10% aqueous slurry. The weight ratio of pulp to filler in the stock was 70:30. The binder consisted of a 0.5% aqueous solution of guar gum GENDRIV 162 and a 1.5% silicic acid sol with a surface area of 500 m$^2$/g and a ratio $SiO_2$:$Na_2O$=35. In the reference tests, only the indicated guar gum was used. In preparing the stock, pH was adjusted to 4.4. In the preparation of stocks 21–25, the filler and silicic acid sol were blended prior to being mixed with the pulp. After mixing the filler and the pulp, the cationic guar gum was added, followed by pH adjustment with sulfuric acid and finally sheet formation. The compositions and the Z-strength, established according to Alwetron, of the stocks appear from Table 4.

EXAMPLE 5

Also in this Example, hand-made sheets were made in a laboratory wire mould. The pulp consisted of fully bleached pine sulfate pulp with a beating degree of 470 CSF. The filler was C-clay (10% aqueous slurry). In stocks 30–32 of the invention, the binder consisted of cationic guar gum GENDRIV 162 (0.5% aqueous solution), a 1.5% silicic acid sol with a surface area of 500 $m^2/g$ and a ratio $SiO_2:Na_2O=35$. In reference tests 26–29, use was made of PERCOL 140 (0.01%) as retention aid. In stocks 26, 27, 28, 30 and 31, pH was adjusted to 4.4, while the pH in stocks 29 and 32 was adjusted to 9.0.

In the preparation of the stocks, the pulp was first batched and then the filler which, when silicic acid sol was used, had been pretreated with the silicic acid sol. Thereafter, where applicable, cationic guar gum was added, followed by pH adjustment with sulfuric acid in stocks 26–28, 30 and 31, and sodium hydroxide in stocks 29 and 32.

Figure 4:
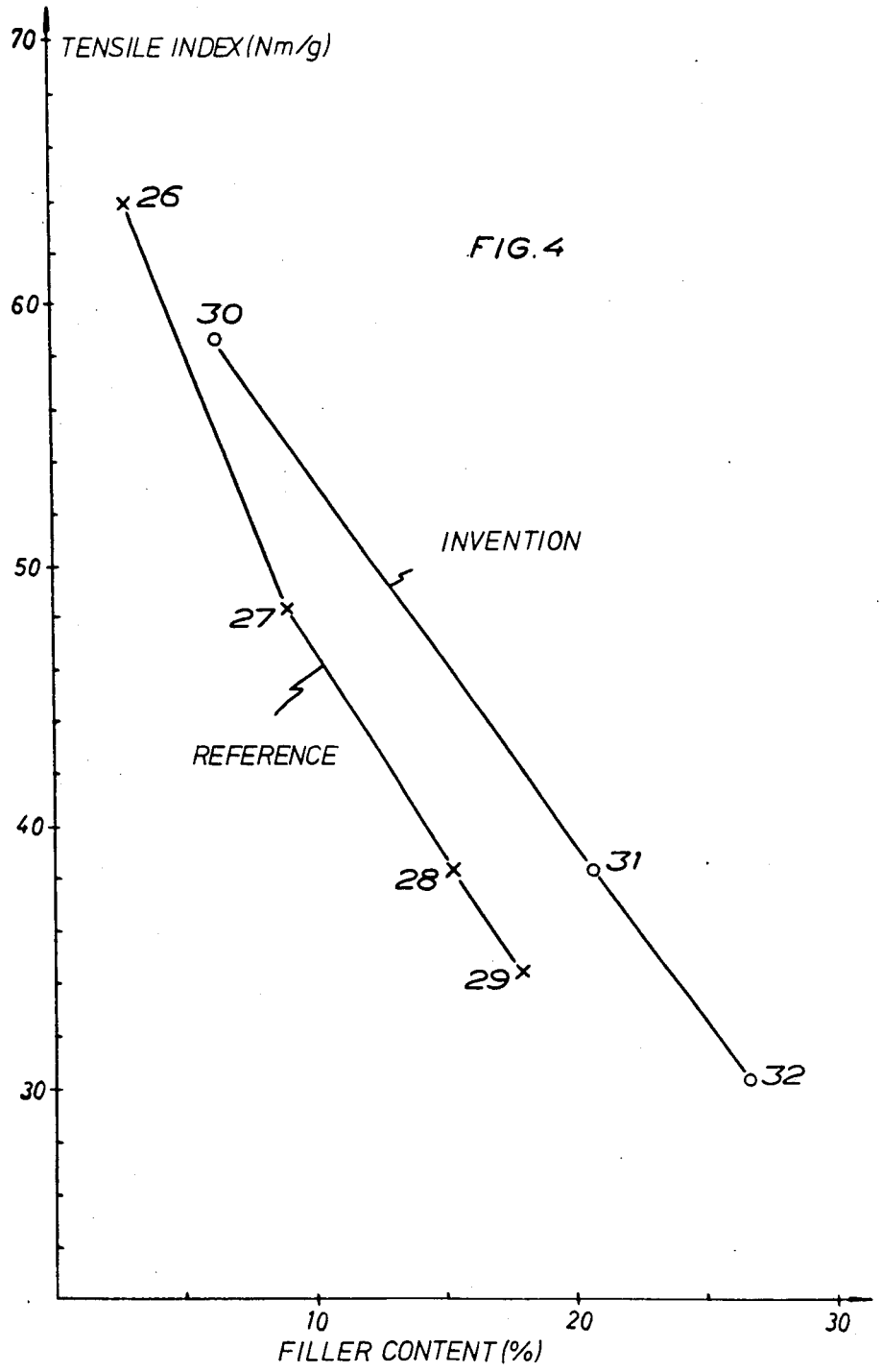
Figure 5:
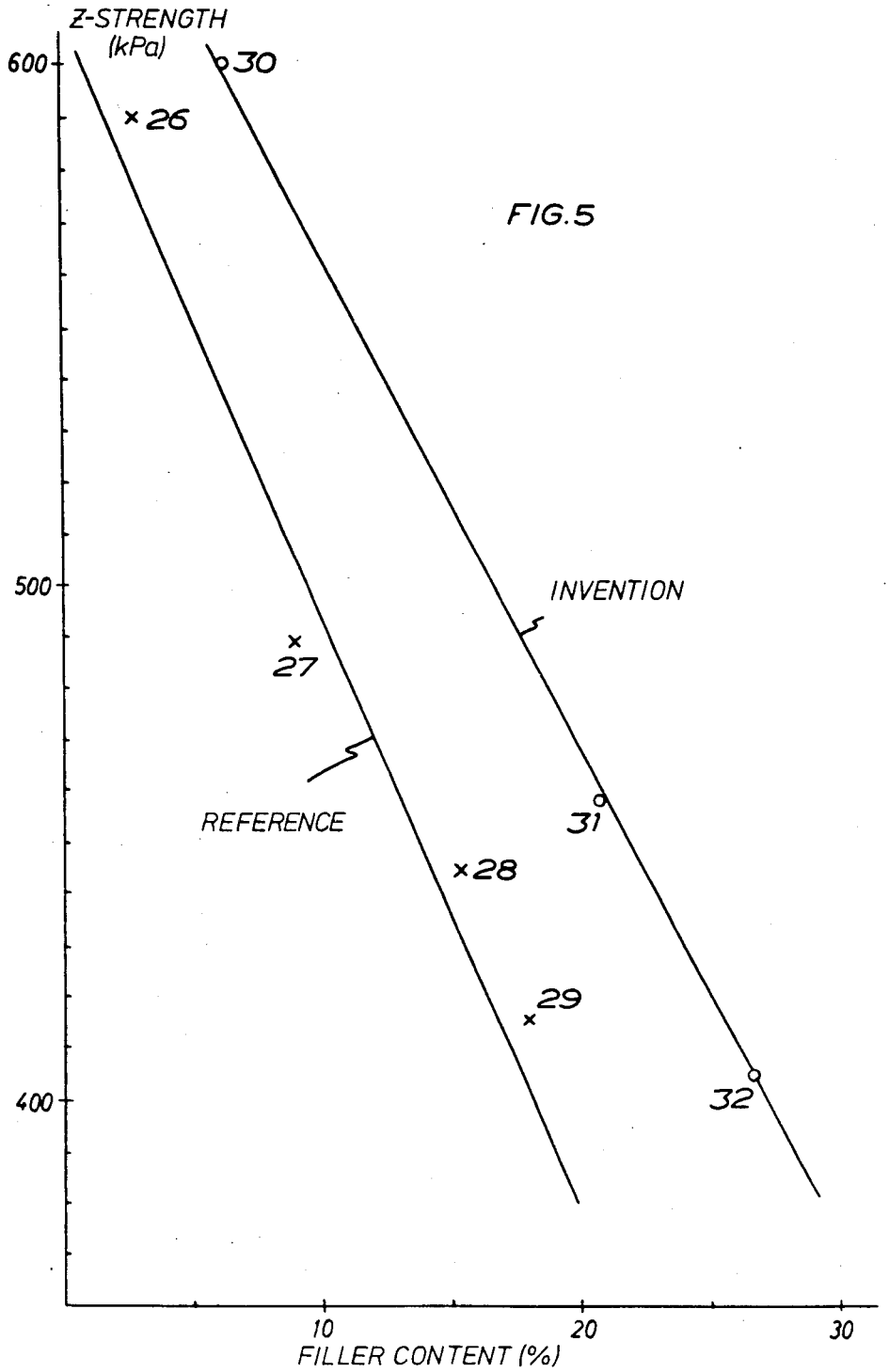

As appears from Table 5 and FIGS. 4 and 5 it is possible by using the present invention, to increase the filler content while maintaining a certain tensile index and to obtain the same advantageous effect in regard of the Z-strength (FIG. 5).

EXAMPLE 6

Figure 6:
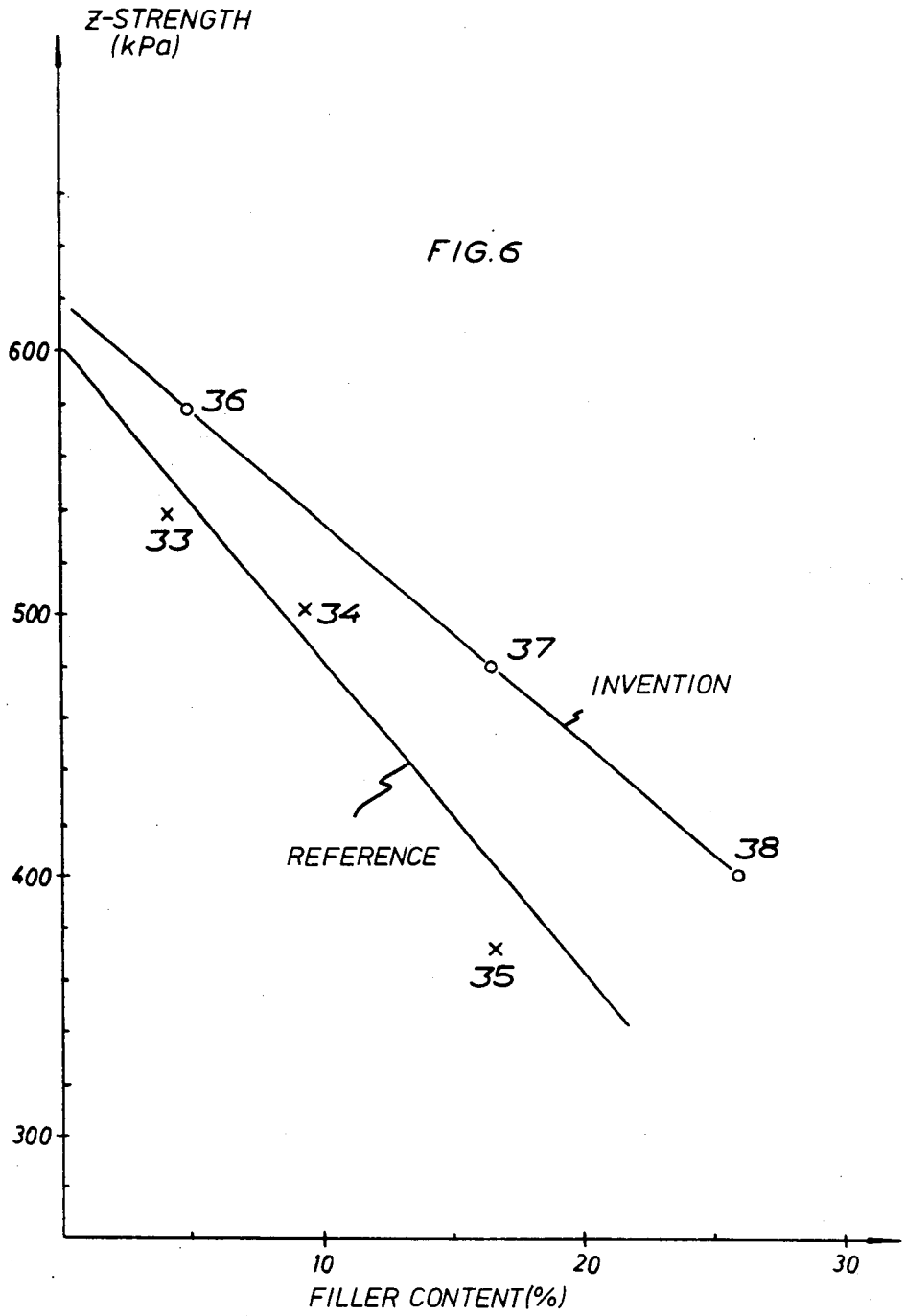

In a laboratory wire mould, hand-made sheets were produced from different stocks prepared from fully bleached pine sulfate pulp with a beating degree of 470 CSF. As filler, use was made of a 10% aqueous slurry of chalk (SJÖHÄSTEN NF). The binder consisted of the cationic guar gum GENDRIV 162 (0.5%) and a 1.5% silicic acid sol with a surface area of 550 $m^2/g$ and a ratio $SiO_2:Na_2O=40$. As reference, use was made of PERCOL 140 (0.01%) in stocks 33–35. The pH was adjusted 7.0. The stocks were prepared according to the previous Examples. The composition of the stock and the test results are apparent from Table 6 and the diagram in FIG. 6. As appears from Table 6 and FIG. 5, the binder composition according to the invention results in a considerable strength increase also when using chalk as filler.

EXAMPLE 7

This Example is a retention test utilizing a dynamic dewatering vessel (Britt-jar). The fibre part of the stock consisted of 25% fully bleached softwood sulfite pulp with a beating degree of 25° SR, 25% fully bleached pine sulfate pulp with a beating degree of 25° SR and 50% thermo-mechanical pulp with an ISO-brightness of 70 and beating degree of 80 CSF. The latter pulp contained the white water and all the pulps had been taken from a paper mill. As filler, use was made of a 10% aqueous slurry of Superfill clay from English China Clay Limited. The binder consisted of a 0.5% solution of cationic guar gum GENDRIV 162 and a 1.5% silicic acid sol with a surface area of 550 $m^2/g$ and a ratio $SiO_2:Na_2O=40$. In reference test 30, alum (1% solution) was used, whereas reference test 40 is a binder according to the above-mentioned Swedish patent application No. 8003948-0 and corresponding published European patent application No. EP-A-0041056, in which a binder agglomerate of silicic acid sol and cationic starch (0.5% concentration) is employed. The mode of operation in these retention tests has been described above. In the tests, the pH of the stock was adjusted to 5.5 and the agitator speed was 1000 rpm.

From Table 7 appears that improved filler retention is obtained when passing from alum in reference sample 39 to the combination of silicic acid sol and cationic starch in stock 40. It will further be apparent that the invention provides further improvements in filler retention even though a smaller total amount of added chemicals was used.

EXAMPLE 8

This Example also relates to retention tests in a dynamic dewatering vessel (Britt-jar). In this case, the stock was prepared from a pulp which consisted of 80% groundwood pulp with a beating degree of 100 CSF, and 20% pine sulfate pulp with a beating degree of 470 CSF. C-clay (10% aqueous slurry) was used as filler in an amount of 20%, calculated on the stock. As binder in stocks 44 and 45, use was made of a 0.5% solution of the cationic guar gum GENDRIV 162, and a 1.5% silicic acid sol with a surface area of 505 $m^2/g$ and a ratio $SiO_2:Na_2O=35$. In reference stock 43, PERCOL 140 (0.01%) was used as retention aid, whereas stock 42 was a zero sample without chemical additives. In all cases, pH was adjusted to 5.4 and the agitator was run at a speed of 1000 rpm.

It will be seen from the results in Table 8 that the invention (stocks 44 and 45) entails a considerable improvement in filler retention.

EXAMPLE 9

In this Example, an investigation was carried out on a mixture of amphoteric or cationic guar gum and cationic starch together with silicic acid sol for the formation of a binder complex in the stock. The dosages of the different chemicals were selected such that constant chemical cost was obtained at current prices of the chemicals. In the tests, the following guar gum types were used:

| | | |
|---|---|---|
| GENDRIV 162 | cationic | 1.5% N |
| GENDRIV 158 | cationic | 1.0% N |
| CELBOND 22 | cationic | 0.75% N |
| CELBOND 120 | amphoteric | 0.95% N |

As starting value, a ratio of 3:10 was used for silicic acid sol to cationic starch, since this is a common dosage for a binder system according to SE patent application No. 8003948-0 and the corresponding published European patent application No. EP-A-0041056.

The stock composition in these tests comprised 70% by weight of fully bleached pine sulfate with a beating degree of 340 CSF and 30% C-clay. The clay was added as a 10% slurry in water, the guar gum as a 0.5% aqueous solution, the cationic starch as a 0.5% aqueous solution and the sol as a 1.5% silicic acid sol with a surface area of 505 $m^2/g$ and a ratio $SiO_2:Na_2O=35$. The cationic starch had a d.s. of 0.047%. The pH of the stock was adjusted to 7.0.

Figure 7:
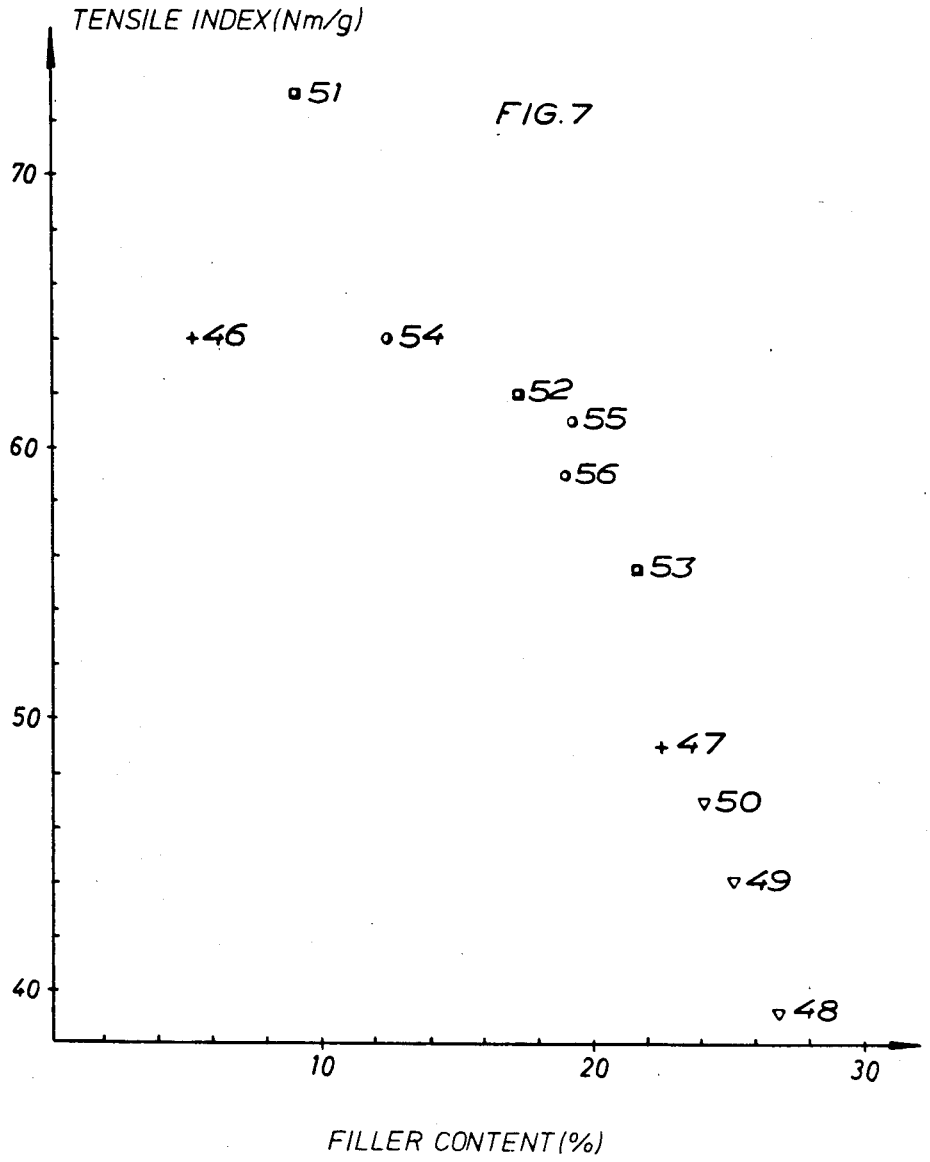
FIG. 7 shows the effect on tensile strength and filler content using a mixture of amphoteric or cationic guar gum and ationic starch together with silicic acid sol.

Sheets prepared in a laboratory wire mould had the properties stated in Table 9 and shown in FIG. 7. It will be concluded from the results that mixtures of cationic starch and guar gum are usable to attain improvements in the qualities of the paper. It could be observed that the paper showed a tendency to become softer on an increase of the proportion of guar gum in the binder composition.

EXAMPLE 10

This Example relates to retention tests using a stock from a commercial papermaking machine making supercalandered magazine paper. The retention tests were carried out in a dynamic dewatering vessel (Britt-jar). The stock used for the tests contained 15% by weight of fully bleached softwood pulp with CSF 672, 50% by weight of groundwood pulp with CSF 55 and with an ISO-brightness of 70, 15% by weight of broke with CSF 107, and 20% by weight of C grade clay.

The stock was diluted with the filtered water coming from the disc filter of the papermaking machine so that all interfering organic substances should be present. The concentration of the diluted stock was 5 g/liter. The pH was 6.2.

The diluted stock was poured into the Britt-jar, and the agitator was started (speed 1000 rpm). During a time period of 15 s each, alum, guar gum (GENDRIV 162, 1.5% aqueous solution) and a 1.5% silicic acid sol (surface area about 550 $m^2/g$ and a ratio $SiO_2:Na_2O=35$) were added consecutively to the Britt-jar. Thereafter the sucking off of the water was started to enable the establishment of the retention as described above. The test results appear from Table 10.

It will be appreacited from Table 10 that there was a considerable increase of both the total retention and the filler retention when using the invention (stock 60) and that the increase was not a cumulative but a synergetic one.

EXAMPLE 11

This Example relates to a retention test in which the strength of the flocks formed in the stock was assessed by varying the rotational speed of the agitator in a dynamic dewatering vessel (Britt-jar). Use was made of a stock from a commercial papermaking machine making a low-density coated wood-containing paper or LWC-paper. The stock contained 39% by weight of groundwood pulp with 74° SR, 30% by weight of pine sulfate pulp with 22° SR, 21% by weight of broke with 66° SR, and 10% by weight of C grade clay.

The stock was diluted with the supernatant water from a sedimentation funnel connected to the papermaking machine. This water had a chemical oxygen demand (COD) of 1300 mg/liter and a conductivity of 3000 μS/cm.

In all tests 61–69, inclusive, 1% by weight of alum was added to the diluted stock which was then poured into the Britt-jar and agitated at the speed indicated for 15 s, before adding any retention aid or binder. In tests 61, 62 and 63, the retention aid was then added and agitated for 15 s before starting the sucking off of the water from the stock. In tests 64–69, inclusive, the silicic acid sol was first added and agitated for 15 s, and the guar gum was then added and agitated for 15 s before starting the sucking off of the water from the stock. The pH was 6.5, and the retention aid added in tests 61, 62 and 53 was PERCOL E24.

Figure 8:
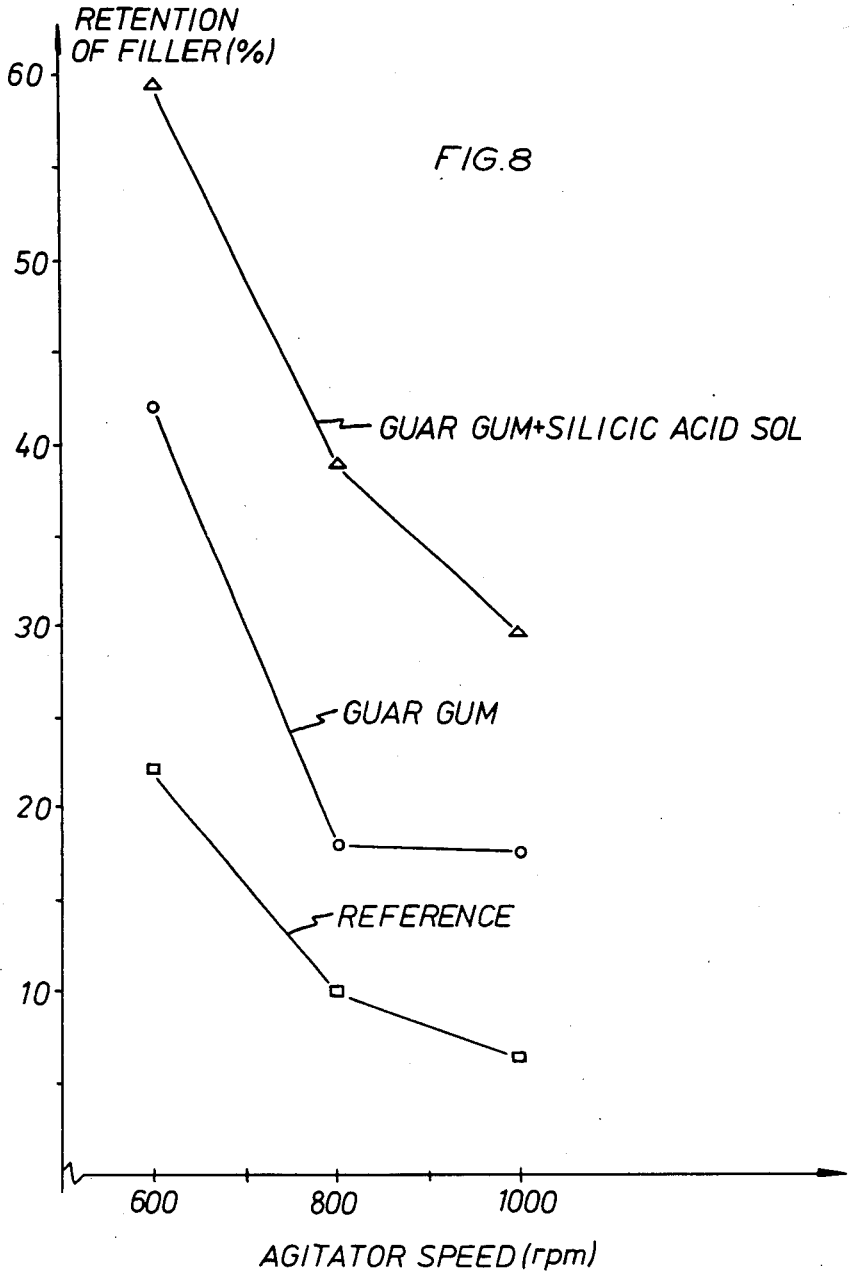
FIG. 8 show the effect of agitator speed on filler retention for sheets prepared from cationic guar gum and silicic acid sol, guar gum alone and cationic polyacrylamide.

As appears from the test results in Table 11 and FIG. 8, the invention substantially improves the retention of the filler at all agitator speeds. Judging from the results, the binder complex of the invention reacts to increased agitator speeds in about the same way as the known retention aid although at a substantially higher retention level.

TABLE 1

| Stock | Proportion pulp to clay in stock | Silicic acid sol % | Cationic guar gum % | PERCOL 140 % | Grammage $g/m^2$ | Density $kg/m^3$ | Tensile index Nm/g | Filler content % |
|---|---|---|---|---|---|---|---|---|
| 1. Ref. | 90:10 | — | — | 0.025 | 72.4 | 630 | 63.9 | 2.9 |
| 2. Ref. | 70:30 | — | — | 0.025 | 58.8 | 620 | 47.8 | 11.6 |
| 3. Ref. | 50:50 | — | — | 0.025 | 69.0 | 590 | 34.5 | 17.6 |
| 4. Inv. | 90:10 | 0.2 | 0.32 | — | 75.6 | 626 | 58.6 | 6.3 |
| 5. Inv. | 80:20 | 0.2 | 0.32 | — | 70.1 | 630 | 50.8 | 12.0 |
| 6. Inv. | 70:30 | 0.2 | 0.32 | — | 65.0 | 638 | 38.4 | 20.5 |

TABLE 2

| Stock | Silicic acid sol % | Cationic guar gum % | Grammage $g/m^2$ | Density $kg/m^2$ | Tensile index Nm/g | Tear index mNm/g | Filler content % |
|---|---|---|---|---|---|---|---|
| 7. Reference | — | — | 67.0 | 600 | 64.2 | 13.4 | 5.4 |
| 8. Reference | — | — | 69.0 | 590 | 34.5 | 12.0 | 17.6 |
| 9. CELBOND 22 | 0.3 | 0.5 | 70.0 | 715 | 71.0 | 11.6 | 8.9 |
| 10. GENDRIV 162 | 0.3 | 0.5 | 86.0 | 595 | 40.0 | 13.2 | 26.8 |

TABLE 3

| Stock | Silicic acid sol % | Cationic guar gum % | Grammage $g/m^2$ | Density $kg/m^2$ | Tensile index Nm/g | Tensile energy absorption index J/kg | Filler content % | Proportion pulp to clay in stock |
|---|---|---|---|---|---|---|---|---|
| 11 Zero | — | — | 85.3 | 561 | 52.0 | 803 | 0.0 | 100:0 |
| 12 Zero | — | — | 85.2 | 572 | 35.8 | 411 | 13.4 | 83:17 |
| 13 Zero | — | — | 86.1 | 607 | 23.6 | 197 | 29.1 | 63:35 |
| 14 Ref. | — | 1.0 | 89.5 | 585 | 58.6 | 960 | 0.0 | 100:0 |
| 15 Ref. | — | 1.0 | 86.6 | 618 | 44.7 | 542 | 13.6 | 83:17 |

TABLE 3-continued

| Stock | Silicic acid sol % | Cationic guar gum % | Grammage g/m² | Density kg/m² | Tensile index Nm/g | Tensile energy absorption index J/kg | Filler content % | Proportion pulp to clay in stock |
|---|---|---|---|---|---|---|---|---|
| 16 Ref. | — | 1.0 | 85.4 | 652 | 31.0 | 293 | 29.0 | 65:35 |
| 17 Inv. | 1.0 | 1.0 | 90.8 | 605 | 71.3 | 1639 | 0.0 | 100:0 |
| 18 Inv. | 1.0 | 1.0 | 90.1 | 626 | 50.8 | 763 | 15.0 | 83:17 |
| 19 Inv. | 1.0 | 1.0 | 89.7 | 660 | 35.6 | 392 | 30.2 | 65:35 |

TABLE 4

| Stock | Ratio guar gum to sol | Silicic acid sol % | Cationic guar gum % | Grammage g/m² | Density kg/m³ | Z-strength kPa | Filler content % |
|---|---|---|---|---|---|---|---|
| 20 | — | — | 0.32 | 65.6 | 631 | 417 | 22.2 |
| 21 | 10.7 | 0.03 | 0.32 | 68.0 | 667 | 420 | 23.0 |
| 22 | 3.2 | 0.10 | 0.32 | 66.5 | 646 | 431 | 24.5 |
| 23 | 1.6 | 0.20 | 0.32 | 68.6 | 647 | 424 | 24.1 |
| 24 | 0.8 | 0.40 | 0.32 | 67.9 | 641 | 475 | 24.8 |
| 25 | 0.4 | 0.80 | 0.32 | 66.5 | 652 | 507 | 22.4 |

TABLE 5

| Stock | pH | PERCOL 140 % | Silicic acid sol % | Cationic guar gum % | Grammage g/m² | Density kg/m³ | Tensile index Nm/g | Z-strength kPa | Filler content % | Proportion pulp to clay in stock |
|---|---|---|---|---|---|---|---|---|---|---|
| 26 Ref. | 4.4 | 0.025 | — | — | 72.4 | 630 | 63.9 | 590 | 2.9 | 90:10 |
| 27 Ref. | 4.4 | 0.025 | — | — | 58.0 | 605 | 48.4 | 489 | 9.0 | 80:20 |
| 28 Ref. | 4.4 | 0.025 | — | — | 60.3 | 590 | 38.4 | 445 | 15.4 | 70:30 |
| 29 Ref. | 9.0 | 0.025 | — | — | 69.0 | 590 | 34.5 | 416 | 18.0 | 70:30 |
| 30 Inv. | 4.4 | — | 0.2 | 0.32 | 75.6 | 620 | 58.6 | 600 | 6.4 | 90:10 |
| 31 Inv. | 4.4 | — | 0.2 | 0.32 | 65.8 | 628 | 38.4 | 458 | 20.9 | 70:30 |
| 32 Inv. | 9.0 | — | 0.2 | 0.32 | 73.6 | 624 | 30.4 | 404 | 26.7 | 70:30 |

TABLE 6

| Stock | PERCOL 140 % | Silicic acid sol % | Cationic guar gum % | Grammage g/m² | Density kg/m³ | Z-strength kPa | Filler content % | Proportion pulp to chalk in stock |
|---|---|---|---|---|---|---|---|---|
| 33 Ref. | 0.023 | — | — | 73.1 | 619 | 538 | 4.1 | 90:10 |
| 34 Ref. | 0.025 | — | — | 58.6 | 592 | 502 | 9.4 | 80:20 |
| 35 Ref. | 0.025 | — | — | 66.5 | 588 | 372 | 16.6 | 70:30 |
| 36 Inv. | — | 0.2 | 0.32 | 76.6 | 649 | 578 | 4.7 | 90:10 |
| 37 Inv. | — | 0.2 | 0.32 | 62.6 | 591 | 480 | 16.5 | 80:20 |
| 38 Inv. | — | 0.2 | 0.32 | 65.0 | 590 | 400 | 26.0 | 70:30 |

TABLE 7

| Stock | Silicic acid sol % | Cationic guar gum % | Cationic starch % | Alum % | Filler retention % | Proportion pulp to clay in stock |
|---|---|---|---|---|---|---|
| 39 Ref. | — | — | — | 0.3 | 37.0 | 80:20 |
| 40 Ref. | 0.17 | — | 0.58 | — | 42.5 | 80:20 |
| 41 Inv. | 0.17 | 0.27 | — | — | 54.1 | 80:20 |

TABLE 8

| Stock | Silicic acid sol % | Cationic guar gum % | PERCOL 140 % | Filler retention % |
|---|---|---|---|---|
| 42 Zero test | — | — | — | 11.5 |
| 43 Reference | — | — | 0.025 | 23.0 |
| 44 Invention | 0.05 | 0.08 | — | 30.0 |
| 45 Invention | 0.2 | 0.32 | — | 47.0 |

TABLE 9

| Stock | Silicic acid sol % | Guar gum Type | Guar gum Content | Cationic starch % | Grammage g/m² | Tensile index Nm/g | Filler content % | Density kg/m³ |
|---|---|---|---|---|---|---|---|---|
| 46 Ref. | — | — | — | — | 60.7 | 64.0 | 5.3 | 615 |
| 47 Ref. | 0.3 | — | — | 1.0 | 87.1 | 49.0 | 22.5 | 624 |
| 48 Inv. | 0.3 | GENDRIV 162 | 0.5 | — | 84.2 | 39.5 | 26.8 | 608 |
| 49 Inv. | 0.3 | " | 0.3 | 0.4 | 83.2 | 44.0 | 25.2 | 610 |
| 50 Inv. | 0.3 | " | 0.15 | 0.7 | 81.8 | 47.0 | 24.1 | 601 |
| 51 Inv. | 0.3 | CELBOND 22 | 0.5 | — | 69.4 | 72.5 | 8.9 | 718 |
| 52 Inv. | 0.3 | " | 0.3 | 0.4 | 78.2 | 62.0 | 17.3 | 740 |
| 53 Inv. | 0.3 | " | 0.15 | 0.7 | 80.7 | 55.5 | 21.7 | 745 |
| 54 Inv. | 0.3 | CELBOND 120 | 0.5 | — | 73.1 | 64.0 | 12.4 | 709 |
| 55 Inv. | 0.3 | " | 0.3 | 0.4 | 72.7 | 61.0 | 19.3 | 727 |
| 56 Inv. | 0.3 | " | 0.15 | 0.7 | 79.8 | 59.0 | 19.0 | 745 |

TABLE 10

| Stock | Alum % | Guar gum % | Silicic acid sol % | Total retention % | Filler retention % |
|---|---|---|---|---|---|
| 57 Reference | 1 | — | — | 53.7 | 19.5 |
| 58 Ref. silicic acid sol | 1 | — | 0.2 | 55.0 | 19.7 |
| 59 Ref. guar gum | 1 | 0.3 | — | 63.8 | 42.5 |
| 60 Invention | 1 | 0.3 | 0.2 | 70.1 | 52.8 |

TABLE 11

| Stock | Agitator speed rpm | PERCOL additive % | Silicic acid % | Guar gum % | Filler retention % |
|---|---|---|---|---|---|
| 61. Ref. | 600 | 0.02 | — | — | 22.0 |
| 62. Ref. | 800 | 0.02 | — | — | 10.0 |
| 63. Ref. | 1000 | 0.02 | — | — | 6.5 |
| 64. Guar gum | 600 | — | — | 0.5 | 42.0 |
| 65. Guar gum | 800 | — | — | 0.5 | 18.0 |
| 66. Guar gum | 1000 | — | — | 0.5 | 17.5 |
| 67. Invention | 600 | — | 0.2 | 0.5 | 59.5 |
| 68. Invention | 800 | — | 0.2 | 0.5 | 39.0 |
| 69. Invention | 1000 | — | 0.2 | 0.5 | 29.5 |

I claim:

1. A papermaking process in which an aqueous papermaking stock containing cellulosic pulp is formed and dried, the improvement which comprises incorporating into the stock prior to the formation of the sheet a binder comprising colloidal silicic acid provided as a colloidal silicic acid sol having silicic acid particles with a surface area from about 50 to 1000 $m^2/g$ and cationic guar gum having a degree of substitution of from 0.01 to about 1.0, the weight ratio of guar gum to $SiO_2$ in the colloidal silicic acid being between 0.01:1 and 25:1, the solids in said binder amounting to 0.1 to 5% of the weight of said pulp.

2. The process of claim 1 wherein the pH of the stock is maintained between 4 and about 9.

3. The process of claim 1 wherein the solids in the binder amount of 1.0–15% of the weight of the pulp.

4. The process of any one of claims 1, 2 and 3 wherein between about 20 and 90% of the colloidal silicic acid is intermixed in the stock, thereafter intermixing the guar gum in the stock containing the initial portion of colloidal silicic acid, and, after an agglomerate has formed, adding and intermixing the remainder of the collodial silicic acid in the stock prior to the formation of the sheet.

5. In a papermaking process in which an aqueous papermaking stock containing a sufficient amount of cellulosic pulp to a give a paper containing at least 50% by weight of cellulosic fiber and a mineral filler material is formed and dried, the improvement which comprises incorporating into the stock prior to the formation of the sheet a binder comprising colloidal silicic acid in the form of a colloidal silicic sol having silicic acid particles with a surface area of from about 50 to about 100 $m^2/g$ and cationic guar gum having a degree of substitution of from 0.01 to about 1.0, the weight ratio of guar gum to SiO2 in the colloidal silicic acid being between 0.1:1 and 25:1, the solids in said binder amounting to from about 0.5 to 25% by weight based upon the weight of the mineral filler.

6. The process of claim 5 wherein the solids in the binder amount to from about 2.5 to 15% by weight, based upon the weight of the mineral filler.

7. The process of claim 5 wherein the colloidal silicic acid is added to and mixed with the mineral filler prior to incorporating the mineral filler into the stock, and that the guar gum is mixed with the mixture of pulp, filler and colloidal silicic acid.

8. The process of any one of claims 5, 6 and 7 wherein between 20 and 90% of the colloidal silicic acid is intermixed in the stock, thereafter intermixing the guar gum in the stock containing the initial portion of colloidal silicic acid, and, after an agglomerate has formed, adding and intermixing the remainder of the colloidal silicic acid in the stock prior to the formation of the sheet.

9. The process of any one of claims 4 and 13 wherein the cationic guar gum has a degree of substitution of at least 0.05.

10. The process of any one of claims 4 and 13 wherein the cationic guar gum has a degree of substitution of at least from 0.08 to 0.5.

11. The process of any one of claims 4 and 13 wherein the silicic acid particles have a surface area of from 200 to 1,000 $m^2/g$.

12. The process of any one of claims 4 and 13 wherein the silicic acid particles have a surface area of from 300 to 700 $m^2g$.

13. An improved paper product containing cellulosic fibers, in a content of at least 50% by weight of the paper product and characterised by enhanced strength characteristics, wherein the bond between the cellulosic fibers is enhanced by a binder comprising a complex of a colloidal silicic acid having silicic acid particles with a surface area of from about 50 to 1000 $m^2/g$ and a cationic guar gum having a degree of substitution of from 0.1 to about 1.0 and wherein the ratio guar gum:-$SiO_2$ in the colloidal silicic acid is between 0.1:1 and 25:1.

* * * * *

UNITED STATES PATENT AND TRADEMARK OFFICE

CERTIFICATE OF CORRECTION

PATENT NO. : 4,755,259

DATED : July 5, 1988

INVENTOR(S) : Hans M. Larsson

It is certified that error appears in the above-identified patent and that said Letters Patent is hereby corrected as shown below:

Column 8, line 16, "ationic" should be -- cationic --.

Column 11, line 47, after "adjusted" insert -- to --.

Column 17, line 33, insert after "surface area" -- of --.

Column 17, line 36, cancel "0.01:1 and substitute -- 0.1:1 --.

Column 17, line 37, cancel "5%" and substitute -- 15% --

Column 18, line 6, cancel "100" and substitute -- 1000 --.

Column 18, line 29, cancel "4 and 13" and substitute -- 1, 2, 5, 6 and 7 --.

Column 18, line 32, cancel "4 and 13" and substitute -- 1, 2, 5, 6 and 7 --.

Column 18, line 35, cancel "4 and 13" and substitute -- 1, 2, 5, 6 and 7 --.

UNITED STATES PATENT AND TRADEMARK OFFICE

CERTIFICATE OF CORRECTION

PATENT NO. : 4,755,259

DATED : July 5, 1988

INVENTOR(S) : Hans M. Larsson

It is certified that error appears in the above-identified patent and that said Letters Patent is hereby corrected as shown below:

Column 18, line 38, cancel "4 and 13" and substitute -- 1,2,5,6 and 7 --.

Signed and Sealed this

Seventeenth Day of January, 1989

*Attest:*

DONALD J. QUIGG

*Attesting Officer*

*Commissioner of Patents and Trademarks*